United States Patent [19]

Wolf

[11] Patent Number: 4,758,031

[45] Date of Patent: Jul. 19, 1988

[54] RETRACTABLE SAFETY LATCH FOR CASES

[75] Inventor: Walter C. Wolf, Rancho Palos Verdes, Calif.

[73] Assignee: Thermodyne International Ltd., Long Beach, Calif.

[21] Appl. No.: 911,500

[22] Filed: Sep. 25, 1986

[51] Int. Cl.[4] ..... E05C 19/14

[52] U.S. Cl. ..... 292/111; 292/113; 292/DIG. 31; 292/DIG. 61

[58] Field of Search ..... 292/247, 111, 256.69, 292/113, 129, DIG. 61, 98, DIG. 31

[56] References Cited

U.S. PATENT DOCUMENTS

| | | | |
|---|---|---|---|
| 1,329,869 | 2/1920 | Willringhaus . | |
| 1,455,625 | 5/1923 | Langenau . | |
| 1,684,499 | 9/1928 | Mayer | 292/DIG. 31 X |
| 2,739,003 | 3/1956 | Clarke . | |
| 2,820,995 | 1/1958 | Schlueter | 292/111 X |
| 2,853,752 | 9/1958 | Schlueter | 292/111 X |
| 2,991,106 | 7/1961 | Claud-Mantle . | |
| 3,145,038 | 8/1964 | Swanson | 292/113 |
| 3,181,726 | 5/1965 | Parker . | |
| 3,204,993 | 9/1965 | Swanson | 292/111 |
| 3,295,877 | 1/1967 | Swanson | 292/65 X |
| 3,936,082 | 2/1976 | Swanson | 292/247 X |
| 4,181,333 | 1/1980 | Stelma | 292/113 X |
| 4,284,202 | 8/1981 | Barstow . | |
| 4,307,906 | 12/1981 | Schenk | 292/247 |
| 4,560,190 | 12/1985 | Werner | 292/111 |

FOREIGN PATENT DOCUMENTS

| | | | |
|---|---|---|---|
| 589601 | 12/1959 | Canada | 292/111 |
| 173119 | 11/1952 | Fed. Rep. of Germany | 292/113 |

*Primary Examiner*—Lloyd A. Gall

*Attorney, Agent, or Firm*—Lee W. Tower

[57] ABSTRACT

A retractable safety latch is disclosed and includes a base mounting member having perpendicular base walls, a draw bar guide attached to the mounting base member by a hinge, a draw bar having an arcuate hook on one end and an eccentrically positioned oblong hole on the other end slidably mounted on the draw bar guide, a rotatable shaft mounted on the draw bar guide and having an eccentrically mounted pin extending through the oblong hole for driving and retaining the draw bar in the draw bar guide, and a handle having a safety catch pivotably mounted on the rotatable shaft. Between the handle and the rotatable shaft is a spring for the purpose of biasing the handle in one direction with respect to the rotatable shaft so that when the latch is closed, the handle is in contact with the perpendicular base walls and the safety catch catches on one of the perpendicular base walls to prevent the rotatable shaft on which the handle is mounted from rotating and opening the latch. When the latch is open, the spring biased handle is forced into contact with the draw bar and a second spring mounted on the hinge coupled between the mounting base member and the draw bar guide will force the draw bar guide into a retracted flush position with respect to the case, which prevents the latch from protruding further than necessary from the case.

6 Claims, 2 Drawing Sheets

RETRACTABLE SAFETY LATCH FOR CASES

BACKGROUND OF THE INVENTION

1. Field of the Invention

The present invention relates to latches used to clamp together the top shell and bottom shell of a case, and more particularly to latches which have retractable assemblies and handles.

2. Description of the Prior Art

Special cases are now used to transport sensitive equipment such as electronic equipment all over the world. The equipment must be sent through normal freight handling channels and be able to withstand the resulting rough handling. The special cases have features such as recessed ribbing that allow them to absorb shock on impact and elastometric shock mounts that handle any remaining vibrations. The standard case is that of a "clam shell" design and has a top shell and a bottom shell. The case also has a pair of edge extrusions, one of which has a male edge and the other of which has a female edge, which are mounted on the peripheral rims of the top and bottom shells. The case further has a rubber gasket which is adapted to be placed between the male and the female edges of the edge extrusions so that the case may be sealed. The casing hardware includes hinges, locks, handles and latches.

Latches for these cases are the subject of the present invention. There are a variety of different types of toggle latches presently on the market and some designs recognize the need for a safety catch to prevent accidental opening of the latch. This feature is particularly useful in heavy duty areas such as where the latch is used to retain large containers and when the containers are roughly handled.

A common way to maintain the latch in the closed position so that the conventional lever is not accidentally displaced causing the latch to open is to use a wire to retain the opening lever of the toggle assembly to the fixed portion and maintain a positive lock condition. When the lock is to be opened, the wire must be unwound or cut. Unwinding of the wire can be a time consuming procedure both in opening and refastening of the latch. Similarly, if the latch is to be refastened, the cut wire can naturally not be reattached and a new wire has to be used if one is available.

Another problem with current latches is that the latch often protrudes from the case when the latch is open, which can lead to the latch being accidentally sheared off if the protruding latch and some object have a collision. Also, on some latch designs, the handle of the latch can protrude even when the latch is in a closed position. This can lead to the same problem of the handle or the entire latch being accidentally sheared off, when the protruding handle and some object have a collision.

Accordingly, there is a need for a retractable safety latch which is inexpensive to manufacture. Ease of attachment and operation are important factors, particularly when dealing with a mass produced item such as a latch. Examples of several types of fasteners and toggle latches are in U.S. Pat. Nos. 1,329,869, 2,739,003, 2,991,106, 3,181,726, and 4,284,202. Examples of toggle latches with safety catches are in U.S. Pat. Nos. 1,455,625, 3,936,082, and 4,307,906. U.S. Pat. No. 1,455,625 discloses a pin and detent arrangement for holding the latch in place. U.S. Pat. No. 3,936,082 discloses a luggage latch having means for preventing accidental release. U.S. Pat. No. 4,307,906 discloses a latch having a spring 88 used to hold the handle in a closed position. From all of these references, it is clear that a positive locking latch is desirable and necessary. Accordingly, improvements in this area would be extremely valuable and desirable in the field of manufacturing and using cases and trunks. Also, it would be valuable and desirable to have a latch that is sturdier and less complex than designs in the prior art.

SUMMARY OF THE INVENTION

With the above background in mind, it is among the primary objectives of the present invention to provide an improved latch for use with a container having a top shell and a bottom shell with a pair of edge extrusions, such that the top and bottom shells can be fastened to one another by the latch mounted to the pair of edge extrusions.

It is another object of the present invention to provide a latch that has safety mechanisms to prevent the latch from being damaged or accidentally opened by either rough handling or mechanical vibrations.

It is another object of the present invention to provide a latch that is designed so that when the latch is unlatched that no part of the latch will protrude in such a manner that rough handling may cause that part of the latch to catch on some other object and be sheared off; thereby, damaging the latch and making it inoperable and requiring repair.

It is another object of the present invention to provide a latch that is designed so that when the latch is closed that no part of the latch, including the handle, will protrude in such a manner that rough handling may cause that part of the latch to catch on some other object, the result of which might be to open the latch or to shear off the handle or latch.

It is another object of the present invention to provide a latch that is designed so that when the latch is closed that constant vibration cannot loosen the latch and thereby cause the latch to open.

It is another object of the present invention that the latches are designed to mount on the case edge extrusions, one of which has a male edge and the other of which has a female edge, which are mounted on the peripheral rims of the top and bottom shells.

In accordance with an embodiment of the present invention, there are edge extrusions having male and female joining edges mounted on the peripheral rims of the top and bottom shells of a plastic case. A retractable safety latch is mounted on one of these edge extrusions via a rectangular base member, which is adapted to loosely slide between a pair of L-shaped flanges on the edge extrusion. The rectangular base member has a flange running longitudinally along the base member on one of its sides and a semi-circularly cut hole adjacent to its other side and adapted so that a portion of the base member between its other edge and the semi-circularly cut hole may be forced against one of the L-shaped flanges and the flange may be forced against the other L-shaped flange.

A draw bar guide is attached to the rectangular base assembly by a base hinge, which allows the draw guide to pivot on the rectangular base assembly. The draw bar guide has on each longitudinal edge a U-shaped flange. Slidably mounted between these U-shaped flanges is a draw bar having an arcuate hook on one end and an eccentrically positioned oblong hole near the other end. The draw bar is coupled to a rotatable shaft via a pin which extends through the oblong hole on the draw bar and is eccentrically mounted on the rotatable shaft. The rotatable shaft extends through the draw bar guide and on the other side a handle is attached.

The rotatable shaft can be rotated via the handle through only slightly more than 180 degrees. This is due to the combined operation of the pin eccentrically mounted on the rotatable shaft and the oblong hole eccentrically positioned on the draw bar, which together prevent the rotatable shaft from rotating more than approximately 180 degrees. At one end of the possible rotation the retractable safety latch is in an open position with the draw bar fully extended and at the other end of the possible rotation the retractable safety latch is in a closed position with the draw bar retracted.

The primary mode of operating the latch is to first close the case so that the male and female edges of the edge extrusions are joined, and then to rotate the latch on its base hinge until the arcuate hook on the draw bar is over an L-shaped flange on the mating edge extrusion. Then, by rotating the rotatable shaft via the handle thereon mounted, the eccentrically mounted pin will pull the draw bar toward the rectangular base member mounted on the other edge extrusion, thereby clamping the two opposing shells of the case together.

The handle mounted on the rotatable shaft is itself pivotable to positions angular to the rotatable shaft. A person when operating the handle will generally pivot the handle to a raised position. The handle is biased by a spring to pivot in one direction relative to the rotatable shaft so that when the latch is closed, the handle is biased in a retracted position against base walls attached perpendicularly to the rectangular base member. A safety catch is located on the handle in such a manner that when the latch is closed and the handle is retracted against the base walls by operation of the spring, the base wall will catch the safety catch and prevent the handle and thereby the rotatable shaft from rotating in the direction that would open the latch. Without the safety catch and the spring biasing the handle, the latch could be unintentionally opened by mechanical vibrations, which over a long period of time have been observed to cause latches of this type to rotate open. Also the spring prevents the handle from protruding from the case when the latch is closed. This helps prevent the latch from being opened or damaged by something accidentally hitting the handle.

When the latch is open, the rotatable shaft and thereby the handle are rotated 180 degrees. Since the handle is biased by the spring always in the same direction relative to the rotatable shaft, when the latch is open, the handle is biased by the spring to retract against the draw bar.

There is also a second spring mounted on the base hinge between the rectangular base member and the draw bar guide. When the latch is closed, the second spring opposes the rotation of the latch on its base hinge toward the L-shaped flange on the mating edge extrusion. When the latch is opened, the spring will pivot the draw bar guide on its base hinge into a position flush against the case. Also when the latch is opened, as already described, the handle is biased by a spring to retract against the draw bar. Both of these features are for the purpose of preventing portions of the latch from protruding from the case when the latch is open. This helps prevent the latch from being damaged by something accidentally hitting it.

The features of the present invention which are believed to be novel are set forth with particularity in the appended claims.

Other objects and many of the attendant advantages of this invention will be more readily appreciated as the same becomes better understood by reference to the following detailed descriptions and considered in connection with the accompanying drawings in which like reference symbols designate like parts throughout the figures.

DESCRIPTION OF THE PREFERRED EMBODIMENT

Figure 3:
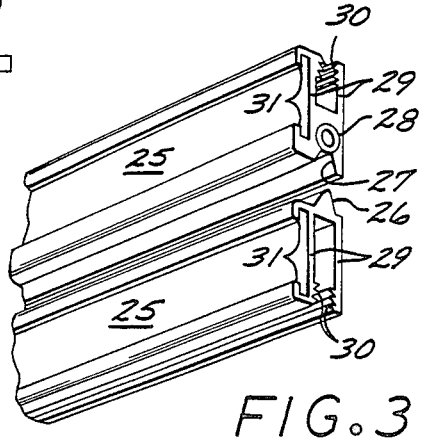
FIG. 3 is a perspective drawing of a section of the two edge extrusions of FIG. 2.
Figure 2:
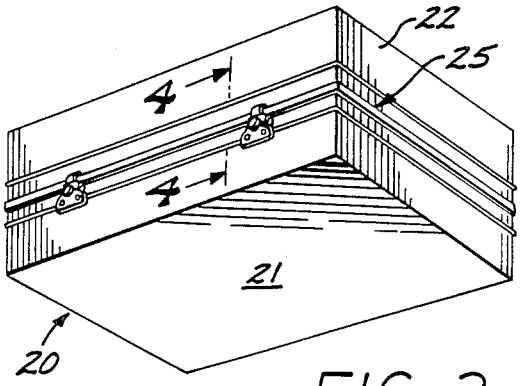
FIG. 2 is a perspective drawing of a container which has an edge extrusion on its top shell and an edge extrusion on its bottom shell with latches mounted thereon.
Figure 1:
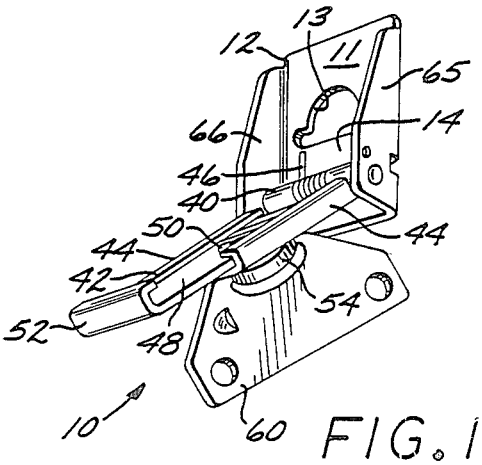
FIG. 1 is a perspective view of a latch, which is constructed in accordance with the principles of the present invention.

The present invention is an improved retractable safety latch 10, as shown in FIG. 1, having rectangular base mounting member 11, which is designed to be mounted on edge extrusions 25 that are on the peripheries of top shell 21 and bottom shell 22 of case 20, as shown in FIG. 2. FIG. 3 is an expanded view of the edge extrusions, which will be described first to explain how the latch is mounted.

Referring now to FIG. 3, the edge extrusion 25 has either a male joining edge 26 or a female joining edge 27, both of which are adapted to be coupled together. A rubber gasket 28 is provided in order to seal the case 20. The edge extrusion 25 has vertical portions 29 which are adapted to slidably fit over the sidewalls of the shells 21 and 22, shown in FIG. 2. The inner surfaces of the vertical portions 29 have ridges 30 disposed so that they secure the edge extrusions 25 to the sidewalls of the shells 21 and 22 after they have been crimped against the sidewalls.

Still referring to FIG. 2, the edge extrusions 25 each have a pair of L-shaped flanges 31 that are oppositely disposed along their longitudinal edges so that the bases of the L-shaped flanges 31 face inward toward each other.

Figure 4:
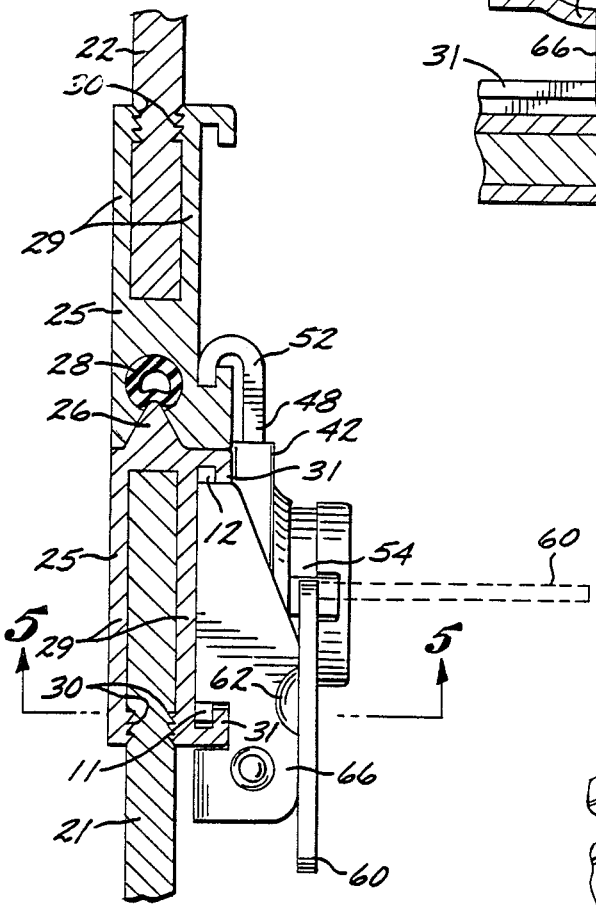
FIG. 4 is a side view of the latch of FIG. 1 in a closed configuration as mounted on the edge extrusions of FIG. 2.
Figure 10:
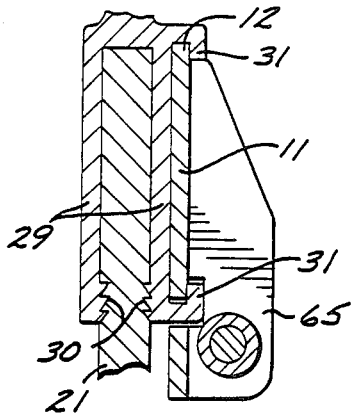
FIG. 10 is a sectional view of a portion of FIG. 7.

Now referring to FIG. 1, the rectangular base member 11 is adapted to be attached to one of the edge extrusions by loosely sliding the rectangular base member 11 betweenn a pair of L-shaped flanges 31. The rectangular base member has a flange 12 adapted for insertion into one of the pair of L-shaped flanges 31 and disposed along one longitudinal edge of the rectangular base member 11. The rectangular base member 11 also has a semi-circularly cut hole 13 adjacent to its other longitudinal edge and is adapted so that a portion 14 between its other edge and the semi-circularly cut hole 13 may be forced against one of the L-shaped flanges 31 and so that flange 12 may be forced against the other L-shaped flange 31 in order to attach and secure the rectangular base member 11 to the edge extrusion 25. FIG. 4 shows how the rectangular base member 11 is attached to one of the edge extrusions. Base walls 65 and 66 are attached perpendicularly to rectangular base member 11. Sectional view FIG. 10 of a portion of FIG. 7 shows a detailed view of base wall 65 and the attachment of rectangular base member 11 to an edge extrusion.

Figure 9:
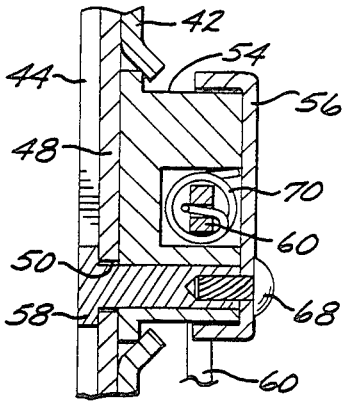
FIG. 9 is a sectional view of a portion of the latch configuration of FIG. 6 showing the handle spring.

Referring again to FIG. 1, the latch 10 has a draw bar guide 42 attached to the rectangular base member by hinge 40. Draw bar guide 42 has on each longitudinal edge a U-shaped flange 44. Draw bar 48 having an arcuate hook 52 on one end and having an oblong hole 50 near the other end is slidably mounted between the U-shaped flanges 44 on draw bar 42. The draw bar 48 is coupled to a rotatable shaft 54 by a pin 58 that is eccentrically mounted on shaft 54 and that extends through oblong hole 50, as shown in FIGS. 7 and 9. The rotatable shaft 54 extends through draw bar guide 42 and on the other side handle 60 is attached.

Figure 7:
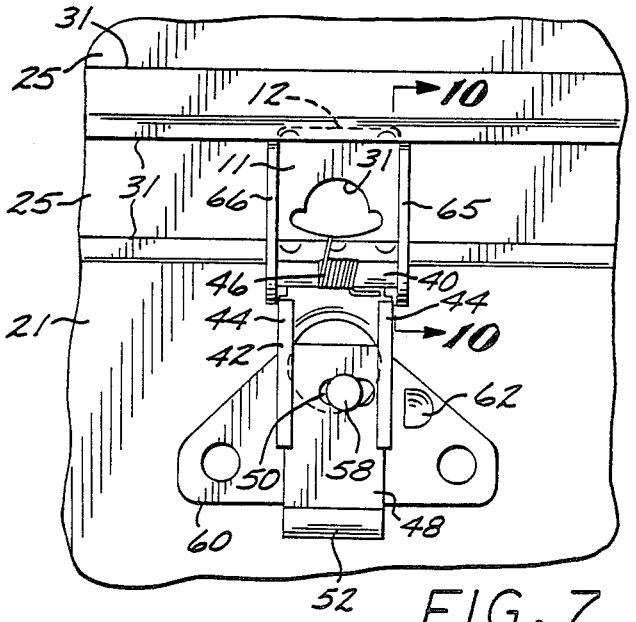
FIG. 7 is a plan view of the latch of FIG. 1 in an open configuration attached to the edge extrusions of the case and showing the spring which holds the latch open.

As shown in FIG. 7, oblong hole 50 is eccentrically positioned on draw bar 48. Rotatable shaft 54 can be rotated via handle 60 through only slightly more than 180 degrees. This is due to the combined operation of pin 58 eccentrically mounted on rotatable shaft 54 and the eccentrically positioned oblong hole 50, which together prevent rotatable shaft 54 from rotating through more than approximately 180 degrees. At one end of the possible rotation the retractable safety latch is in an open position with draw bar 48 fully extended and at the other end of the possible rotation the retractable safety latch is in a closed position with draw bar 48 retracted.

The primary mode of operating the latch is to first close the case so that the male 26 and female 27 edges of the edge extrusions 25 are joined, and then to rotate the draw bar guide 42 on hinge 40 until arcuate hook 52 on draw bar 48 is over an L-shaped flange 31 on the mating edge extrusion on shell 22. Then, by rotating the rotatable shaft 54 via handle 60, the eccentrically positioned pin 58 will pull the draw bar 48 toward the rectangular base member 11 mounted on the other edge extrusion on shell 21, thereby clamping the two opposing shells of the case together, as shown in FIG. 4.

As shown in FIG. 9, handle 60 has handle spring 70 attached to it and located within shaft 54. FIG. 9 also shows that shaft 54 has a cover 56 that is held onto shaft 54 by retainer 68, which is coupled to pin 58. The coupling between retainer 68 and pin 58 is what holds the draw bar 48 within draw bar guide 42.

Figure 8:
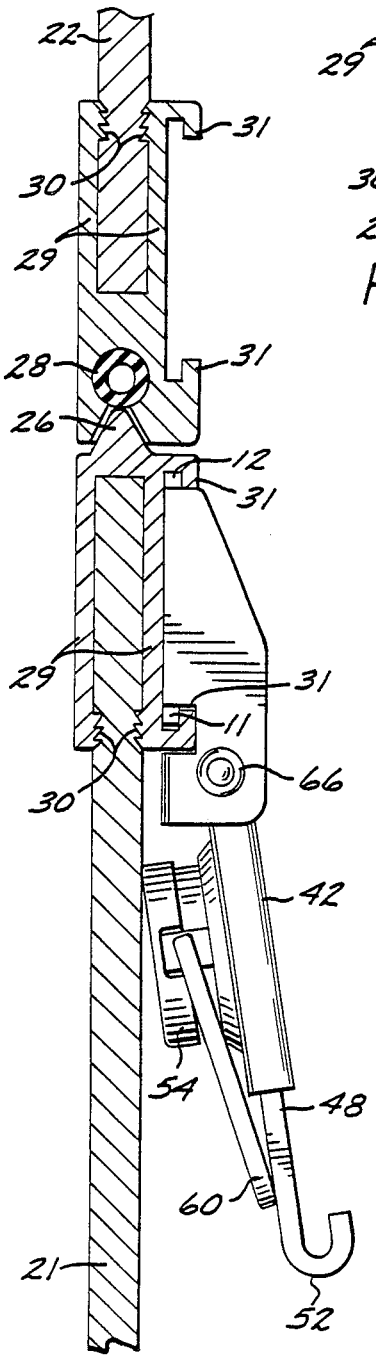
FIG. 8 is a sectional view of the attached latch of FIG. 6 in an open configuration.
Figure 6:
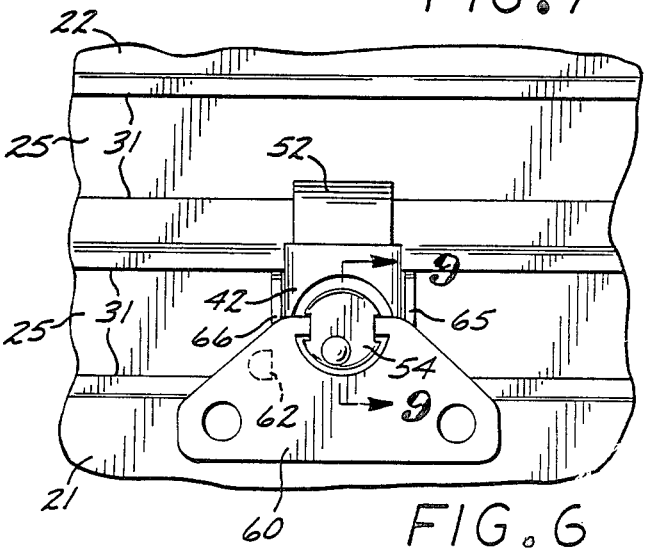
FIG. 6 is a plan view of the closed latch of FIG. 4.

Handle 60 mounted on rotatable shaft 54 is pivotable to positions angular to the rotatable shaft as shown in FIG. 1, FIG. 4 (solid and dotted lines), and FIGS. 6, 7, and 8. A person when operating handle 60 will generally pivot the handle to a raised position, as shown by the dotted lines of FIG. 4.

Figure 5:
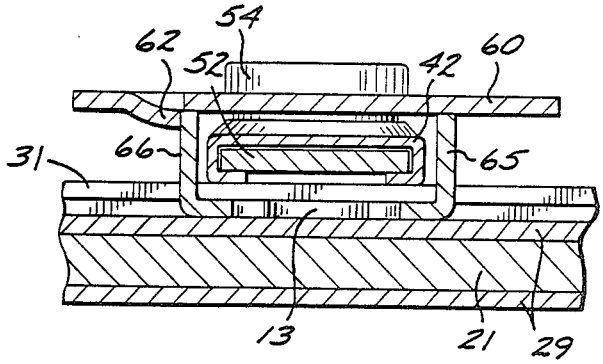
FIG. 5 is a top sectional view of the closed latch configuration of FIG. 4.

Handle 60 is biased by handle spriing 70 in one direction relative to rotatable shaft 54 so that when latch 10 is closed, as shown in FIG. 4 (solid lines) and FIG. 6, handle 60 is biased in a retracted position against base walls 65 and 66 attached perpendicularly to the rectangular base member 11. A safety catch 62 is located on handle 60 in such a manner that when latch 10 is closed and handle 60 is retracted against base walls 65 and 66 by operation of handle spring 70, base wall 66 will catch safety catch 62, as shown in FIGS. 4 and 5, and prevent handle 60 and thereby rotatable shaft 54 from rotating in the counterclockwise direction, as viewed in FIG. 6. Such a direction of rotation would open latch 10. Due to the combined operation of pin 58 eccentrically mounted on the rotatable shaft 54 and the eccentrically positioned oblong hole 50, the rotatable shaft and handle 60 cannot rotate in the clockwise direction, as viewed in FIG. 6. Without safety catch 62 and handle spring 70 biasing handle 60 against base walls 65 and 66, latch 10 could be unintentionally opened by mechanical vibrations, which over a long period of time have been observed to cause latches of this type to rotate open. Also, handle spring 70 prevents handle 60 from protruding from case 20 when latch 10 is closed. This helps prevent the latch from being opened or damaged by something accidentally hitting the handle.

When latch 10 is open, as shown in FIGS. 7 and 8, rotatable shaft 54 and thereby handle 60 are rotated 180 degrees. Since handle 60 is biased by handle spring 70 always in the same direction relative to rotatable shaft 54, when latch 10 is open, handle 60 is biased by handle spring 70 to retract against draw bar 48, as shown in FIG. 8.

A base spring 46, as shown in FIG. 7, is mounted on hinge 40 between the rectangular base member 11 and the draw bar guide 42. When latch 10 is closed, base spring 46 opposes the rotation of the latch on hinge 40 toward L-shaped flange 31 on the mating edge extrusion on shell 22. When latch 10 is opened, base spring 46 will pivot draw bar guide 42 on hinge 40 until rotatable shaft 54 comes into contact with shell 21, as shown in FIG. 8. Also when latch 10 is opened, as already described, handle 60 is biased by handle spring 70 to retract against the draw bar 48, as shown in FIGS. 7 and 8. Both of these features are for the purpose of preventing portions of latch 10 from protruding from the case when the latch is open. This helps prevent the latch from being damaged by something accidentially hitting it. The fact that handle spring 70 retracts handle 60 against draw bar 48 when the latch is open, as shown in FIGS. 7 and 8, is an important feature. Without this feature, handle 60 would possibly be in the way and might not allow rotatable shaft from coming into contact with shell 21 with the result that latch 10 would protrude further than necessary from case 20.

From the foregoing, it can be seen that a retractable safety latch for cases has been described. The advantage of this latch design is that whether the latch is in a closed or open configuration, all parts of the latch will always be retracted as close as possible to the case. This should minimize the damage to open or closed latches caused by objects accidentally hitting the case. Another advantage of this latch design is that the same handle spring that is used for handle retraction is also used to retain the handle safety catch in contact with a perpendicular base wall on the rectangular base member so that accidental opening of the latch is virtually eliminated.

Although the foregoing has been a description and illustration of specific embodiments of the invention, various modifications and changes thereto can be made by persons skilled in the art without departing from the scope and spirit of the invention as defined by the following claims.

What is claimed is:

1. A retractable safety latch for use on a case, which includes a bottom shell having an edge extrusion and a top shell having a mating edge extrusion, that comprises:

a base member mounted on said bottom edge extrusion;

a perpendicular base wall mounted perpendicularly to said base member;

a draw bar guide having U-shaped flanges along its longitudinal edges attached to said base member by a hinge;

a draw bar having an arcuate hook on one end and an eccentrically positioned oblong hole in the other end slidably mounted between said U-shaped flanges on said draw bar guide;

a rotatable shaft mounted on said draw bar guide and having an eccentrically mounted pin extending through said eccentrically positioned oblong hole in said draw bar for driving said draw bar and retaining said draw bar in said draw bar guide and whereby said eccentrically mounted pin and said eccentrically positioned oblong hole operate together to allow said rotatable shaft to rotate through only about 180 degrees with 0 degrees rotation corresponding to an open position for said retractable safety latch with said draw bar fully extended and 180 degrees rotation corresponding to a closed position for said retractable safety latch with said draw bar retracted;

a handle pivotably mounted on said rotatable shaft; and a first spring between said handle and said rotatable shaft that biases said pivotably mounted handle always in one direction with respect to said rotatable shaft so that when said retractable safety latch is in a closed position with said arcuate hook attached to said mating edge extrusion, said handle is biased to be in contact with and resting on said perpendicular base wall, and so that when said retractable safety latch is in an open position, said handle is biased in the same direction with respect to said rotatable shaft and is in contact with said draw bar.

2. The retractable safety latch of claim 1 which further comprises:

a handle safety catch attached to and extending from said handle so that when said retractable safety latch is in a closed position and said handle is biased by said first spring to be in contact with and resting on said perpendicular base wall, said handle safety catch is adjacent to and extends below said perpendicular base wall so that said perpendicular base wall will catch said handle safety catch and stop said handle and said rotatable shaft from rotating to open said retractable safety latch.

3. The retractable safety latch of claim 2 which further comprises:

a second spring mounted on said hinge and coupled between said base member and said draw bar guide which biases said draw bar guide always in one direction so that when said retractable safety latch is opened and said handle is biased by said first spring to be in contact with said draw bar, said second spring will pivot said draw bar guide on said hinge until said rotatable shaft comes into contact with said bottom shell and retain said rotatable shaft in contact with said bottom shell for the purpose of preventing said retractable safety latch from unnecessarily protruding from said case when said retractable safety latch is open.

4. A retractable safety latch for use on a case, which includes a bottom shell having an edge extrusion and a top shell having a mating edge extrusion, that comprises:

a base member mounted on said bottom edge extrusion;

a draw bar guide having U-shaped flanges along its longitudinal edges attached to said base member by a hinge;

a draw bar having an arcuate hook on one end and an eccentrically positioned oblong hole in the other end slidably mounted between said U-shaped flanges on said draw bar guide;

a rotatable shaft mounted on said draw bar guide and having an eccentrically mounted pin extending through said eccentrically positioned oblong hole in said draw bar for driving said draw bar and retaining said draw bar in said draw bar guide and whereby said eccentrically mounted pin and said eccentrically positioned oblong hole operate together to allow said rotatable shaft to rotate through only about 180 degrees with 0 degrees rotation corresponding to an open position for said retractable safety latch with said draw bar fully extended and 180 degrees rotation corresponding to a closed position for said retractable safety latch with said draw bar retracted;

a handle pivotably mounted on said rotatable shaft; and a first spring between said handle and said rotatable shaft that biases said pivotably mounted handle always in one direction with respect to said rotatable shaft so that when said retractable safety latch is in a closed position with said arcuate hook attached to said mating edge extrusion, said handle is biased to be in contact with and resting on said base member, and so that when said retractable safety latch is in an open position, said handle is biased in the same direction with respect to said rotatable shaft and is in contact with said draw bar.

5. The retractable safety latch of claim 4 which further comprises:

a second spring mounted on said hinge and coupled between said base member and said draw bar guide which biases said draw bar guide always in one direction so that when said retractable safety latch is opened and said handle is biased by said first spring to be in contact with said draw bar, said second spring will pivot said draw bar guide on said hinge until said retractable safety latch comes into contact with said bottom shell for the purpose of preventing said retractable safety latch from unnecessarily protruding from said case when said retractable safety latch is open.

6. The retractable safety latch of claim 5 which further comprises:

a perpendicular base wall mounted perpendicularly to said base member; and a handle safety catch extending from said handle so that when said retractable safety latch is in a closed position and said handle is biased by said first spring to be in contact with and resting on said perpendicular base wall, said handle safety catch is adjacent to and extends below said perpendicular base wall so that said perpendicular base wall will catch said handle safety catch and stop said handle and said rotatable shaft from rotating to open said retractable safety latch.

* * * * *